US009458003B1

(12) United States Patent
Laible

(10) Patent No.: US 9,458,003 B1
(45) Date of Patent: Oct. 4, 2016

(54) MULTI-PORT CAP ADAPTER FOR A LIQUID DISPENSING SYSTEM

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 14/585,338

(22) Filed: Dec. 30, 2014

(51) Int. Cl.
*B67D 1/00* (2006.01)
*B67D 7/02* (2010.01)

(52) U.S. Cl.
CPC ..... *B67D 7/0294* (2013.01)

(58) Field of Classification Search
CPC .. B67D 7/0294; B67D 7/0277; F16K 15/147
USPC ..... 222/464.1, 400.7, 547, 481.5, 546, 506, 222/518
See application file for complete search history.

(56) References Cited

U.S. PATENT DOCUMENTS 4,434,810 A * 3/1984 Atkinson ..... F16K 15/147 137/493
4,509,554 A * 4/1985 Failla ..... F16L 29/04 137/329.1
4,830,210 A * 5/1989 Mabille ..... B67D 7/0294 141/383
4,862,918 A * 9/1989 Schroeder ..... B67D 7/0294 137/614.19
5,988,456 A 11/1999 Laible
6,142,345 A 11/2000 Laible
6,619,318 B2 * 9/2003 Dalhart et al. ..... B01F 3/0865 137/565.22
6,669,062 B1 12/2003 Laible
8,844,776 B2 * 9/2014 Haas et al. ..... B67D 7/0294 222/1
2004/0003846 A1 * 1/2004 Seidl ..... F16H 57/027 137/493

* cited by examiner

*Primary Examiner* — Paul R Durand
*Assistant Examiner* — Charles P Cheyney
(74) *Attorney, Agent, or Firm* — Dennis L. Thomte; Thomte Patent Law Office LLC

(57) ABSTRACT

A multi-port cap adapter for a liquid dispensing system is disclosed including a liquid container which supplies liquid to a draw-off mechanism. A cap is removably mounted on the container for selectively closing the outlet opening thereof with the cap having an opening formed therein. A top housing is positioned on the cap with a portion thereof extending downwardly into the cap. The top housing includes take-off members which extend to a draw-off mechanism such as a mixing machine, etc. A flexible, low-profile valve is associated with each of the take-off members. Each of the valves includes a dome-shaped diaphragm having a normally closed slit formed therein. When sufficient vacuum pressure is subjected to the take-off member, the associated valve opens to permit liquid to flow from the container through the valve and outwardly from the associated take-off member to the draw-off mechanism associated therewith.

1 Claim, 5 Drawing Sheets

MULTI-PORT CAP ADAPTER FOR A LIQUID DISPENSING SYSTEM

BACKGROUND OF THE INVENTION

1. Field of the Invention

This invention relates to a liquid dispensing system and more particularly to a liquid dispensing system for dispensing corrosive liquid chemicals or dangerous medical liquid products which are typically drawn from a container, such as a bottle or the like, to a plurality of mixing machines or the like. More particularly, this invention relates to a multi-port cap adapter which is mounted on the liquid container and which has a pair of take-off members extending therefrom, each of which are in communication with a mixing machine or other draw-off mechanisms. Even more particularly, this invention relates to a multi-port cap adapter wherein a low profile valve is associated with each of the take-off members.

2. Description of the Related Art

Corrosive liquid chemicals and dangerous medical liquid products are typically contained in a container such as a bottle or the like and are frequently dispensed therefrom to a mixing machine. Applicant has previously received U.S. Pat. Nos. 5,988,456 and 6,142,345, each of which are entitled "CLOSED LOOP DISPENSING SYSTEM."

In Applicant's earlier devices, as shown and described in U.S. Pat. Nos. 5,988,456 and 6,142,345, a single take-off member is positioned at the upper end of the cap mounted on the container with a tube extending from the take-off member to a mixing machine or other draw-off mechanisms. Although the systems disclosed in the '456 and '345 patents have met with considerable success, those systems are limited in that they can only provide liquid to a single draw-off mechanism.

In Applicant's U.S. Pat. No. 6,669,062, a multi-port cap adapter for a liquid dispensing system is described which enables liquid from a single container to be supplied to at least a pair of draw-off mechanisms. Although the system of U.S. Pat. No. 6,669,062 has met with considerable success, the instant invention represents a significant improvement to that system.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

This invention relates to a dispensing system for use with a container, such as a bottle or the like, having an outlet opening formed in the upper end thereof. A cap is removably mounted on the container for selectively closing the outlet opening. The cap includes a liquid passageway formed therein which has upper and lower ends. A dip tube is operatively fluidly connected to the lower end of the liquid passageway which extends downwardly into the liquid container. An adapter is provided on the upper end of the cap and has a liquid compartment formed therein which is in fluid communication with the upper end of the liquid passageway in the cap. The adapter has a pair of discharge passageways formed therein which are in fluid communication with the liquid compartment. The adapter has a hollow take-off member above each of the discharge passageways which is in fluid communication with the associated discharge passageway. Each of the hollow take-off members are adapted to have a discharge tube secured thereto which extends to a mixing machine or the like which draws liquid thereinto by suction.

A normally closed valve is positioned in each of the discharge passageways which is movable between open and closed positions. Each of the valves includes a dome-shaped diaphragm having a normally closed slit formed therein. Each of the valves permits liquid flow from the liquid compartment to the associated take-off member when in its open position. Each of the valves prevents liquid flow from the associated take-off member to the liquid compartment when in its closed position. Although a pair of take-off members and a pair of valves are described, it is possible that three or more take-off members and valves could be utilized.

It is therefore a principal object of the invention to provide an improved dispensing system for corrosive or dangerous liquids contained in a container such as a bottle or the like.

A further object of the invention is to provide a dual-port cap adapter for a liquid dispensing system which enables liquid from a single container to be supplied to a pair of mixing machines or the like.

Yet another object of the invention is to provide a multi-port cap adapter for a liquid dispensing system including low-profile flexible valves having a dome-shaped diaphragm with a normally closed slit formed therein.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 2:
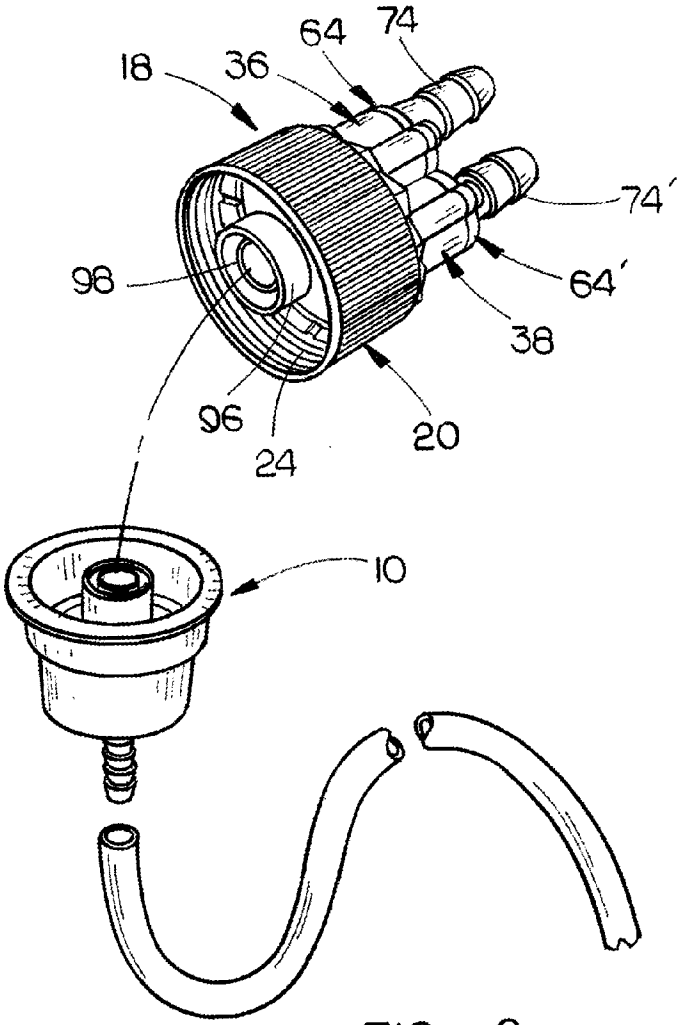
FIG. 2 is an exploded perspective view illustrating the relationship of the adapter of this invention and a throat plug assembly.
Figure 1:
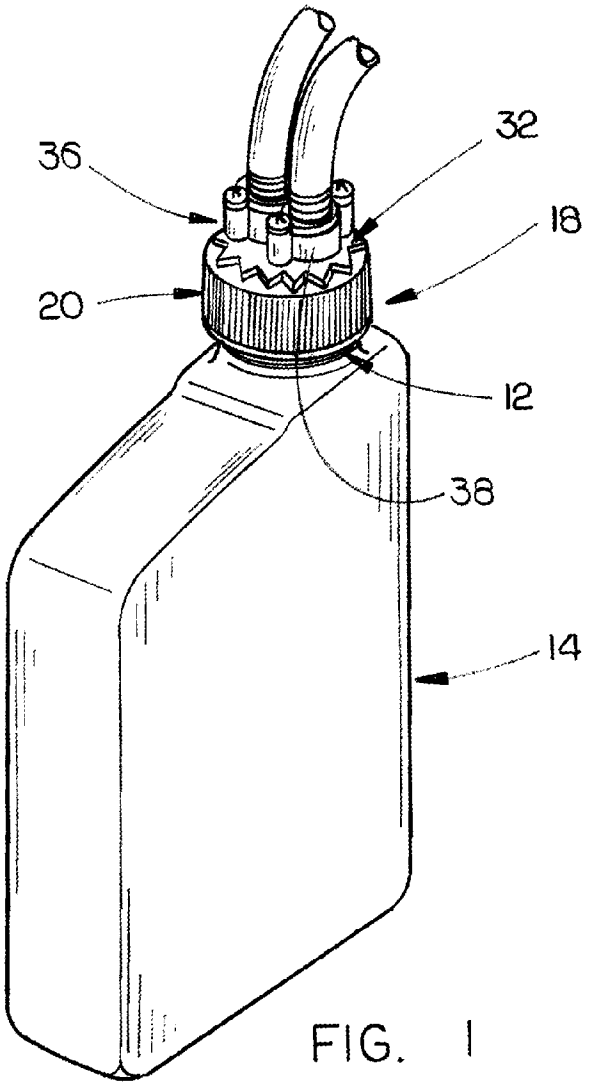
FIG. 1 is a perspective view illustrating the multi-port cap adapter of this invention mounted on a container.
Figure 3:
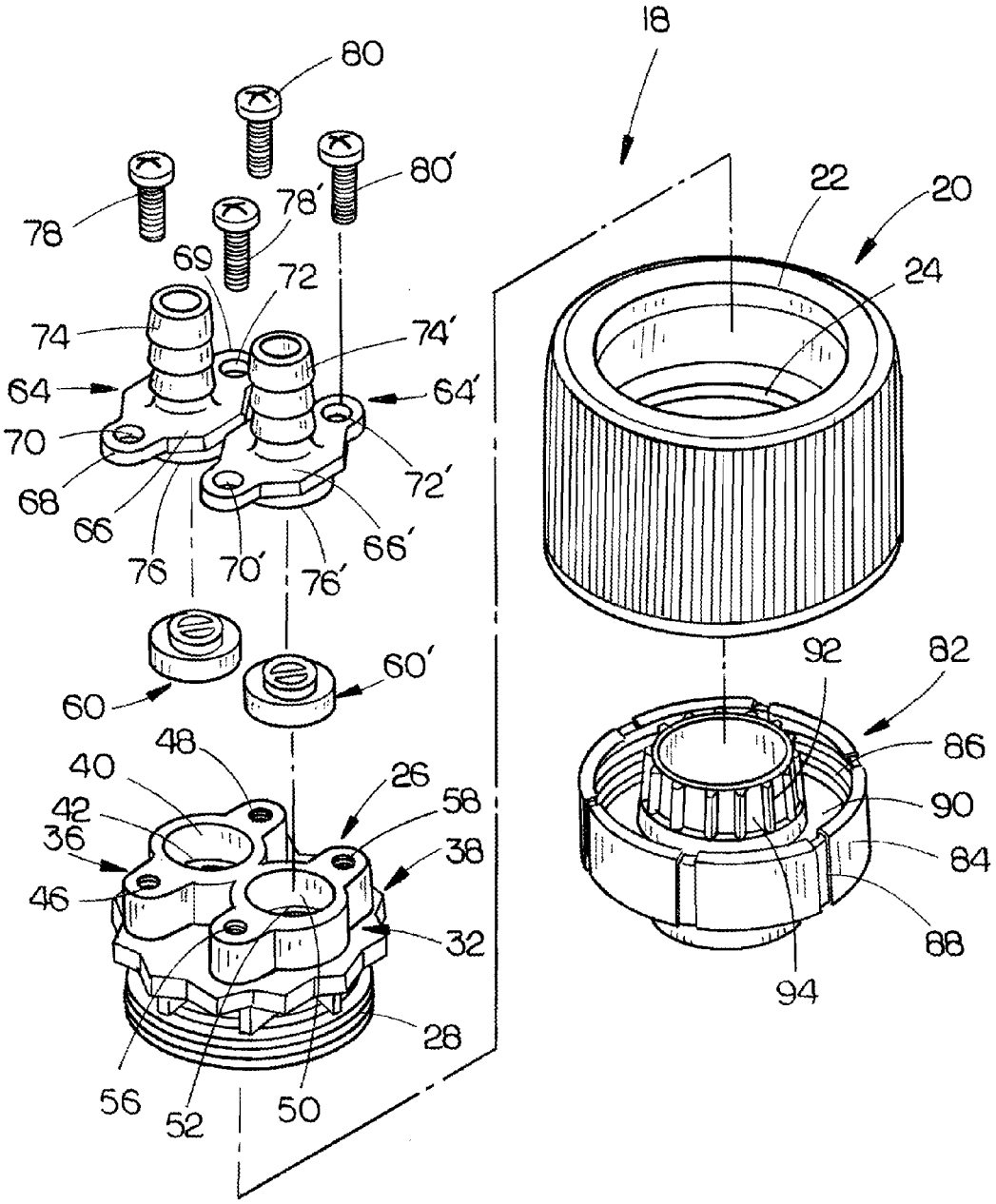
FIG. 3 is an exploded perspective view of the multi-port cap adapter of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Applicant hereby incorporates the disclosures of U.S. Pat. Nos. 5,988,456; 6,142,345 and 6,669,062 by reference thereto to complete this disclosure if necessary.

In the drawings, the numeral 10 refers to a throat plug assembly or container insert which is press-fitted into the throat or outlet opening 12 of a container 14 such as a bottle or the like. Preferably, throat 12 includes external threads 16. The assembly 10 of this invention is similar to the throat plug assemblies described in the '456, '345 and '062 patents although the invention disclosed herein will perform satisfactorily with other throat plug assemblies. In fact, the invention herein will perform satisfactorily with those dispensing systems wherein throat plug assemblies are not used at all.

The numeral 18 refers to the cap adapter of this invention which is configured to be threadably mounted on the throat 12 of the container 14 to supply liquid to at least a pair of draw-off mechanisms such as dispensers, mixing machines, etc. Cap adapter 18 includes a cap or collar 20 having an upper opening 22 formed therein. Cap 20 has internal threads 24 formed therein at its lower open end.

The numeral 26 refers to an upper or top housing having an externally threaded cylindrical portion 28 at its lower end. Top housing 26 has a central opening or passageway 30 extending upwardly thereinto from its lower end. Housing 26 includes a horizontally disposed wall or support 32 which has a greater diameter than the threaded portion 28 of housing 26 and which has a greater diameter than opening 30. Wall 32 has a pair of spaced openings 34 and 35 formed therein. A pair of take-off supports 36 and 38 are molded with wall 32 and extend upwardly therefrom. Support 36 has an opening or bore 40 extending downwardly thereinto, the lower end of which communicates with opening 34 in wall 32. The lower end of bore 40 has an inwardly protruding annular lip or shoulder 42 and a support bar 44 extending thereacross. A pair of spaced-apart screw openings 46 and 48 extend downwardly into the upper outer ends of take-off support 36.

Support 38 has a bore 50 extending downwardly thereinto, the lower end of which communicates with opening 35 in wall 32. The lower end of bore 50 has an inwardly protruding annular lip or shoulder 52 and a support bar 54 extending thereacross. A pair of spaced-apart screw openings 56 and 58 extend downwardly into the upper outer ends of take-off support 38.

A low-profile flexible valve 60 is positioned in bore 40 of support 36 with its lower end resting on lip 42 and support bar 44. A low-profile flexible valve 60' is positioned in bore 50 of take-off support 38 with its lower end resting on lip 52 and support bar 54. Valves 60 and 60', which are identical, will be described in detail hereinafter.

The numerals 64 and 64' designate take-off ports or members which are mounted on take-off supports 36 and 38 respectively. Port 64 includes a flange 66 having ends 68 and 69 which have screw openings 70 and 72 formed therein respectively.

Figure 4:
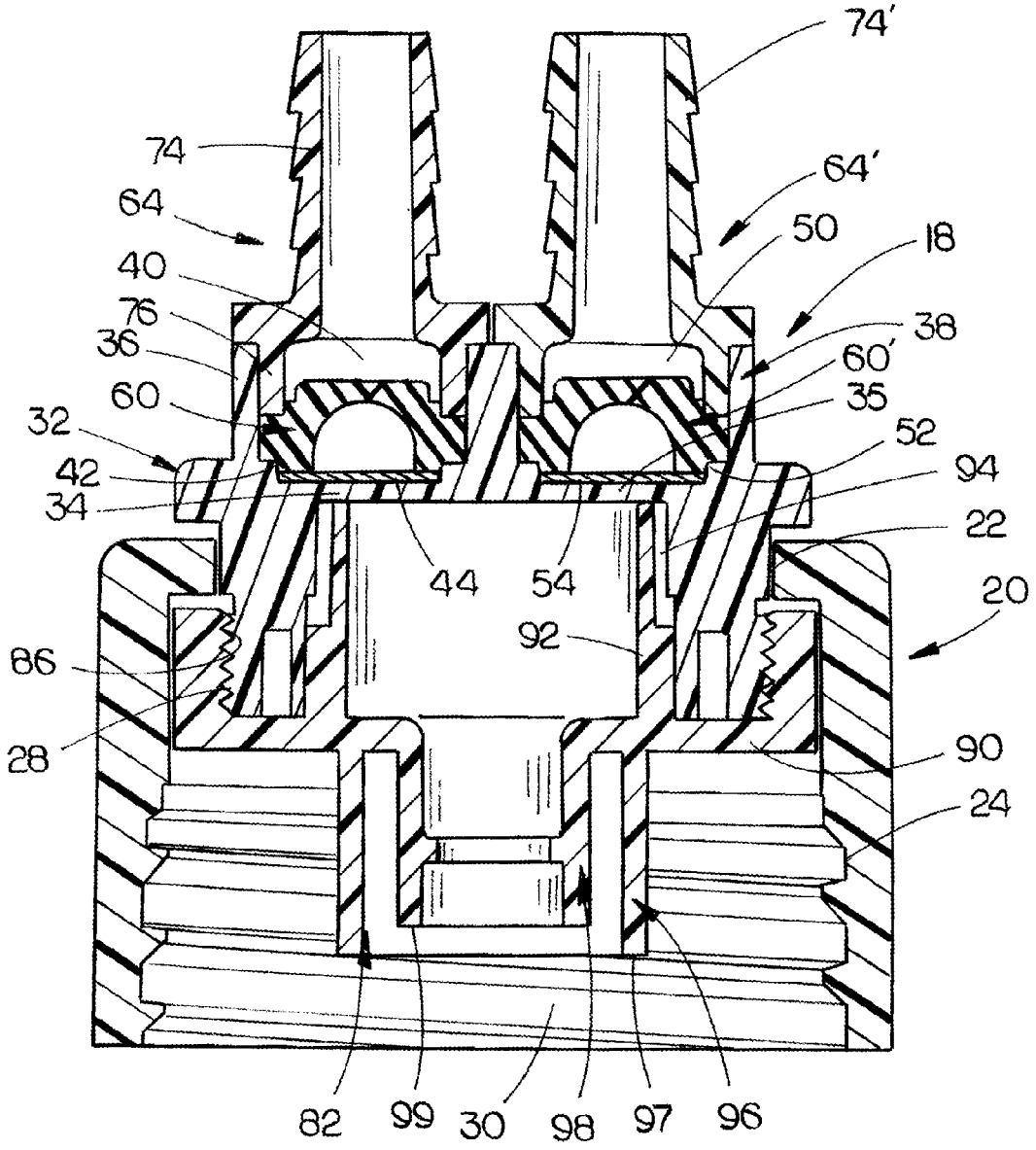
FIG. 4 is a sectional view of the multi-port cap adapter of this invention.
Figure 5:
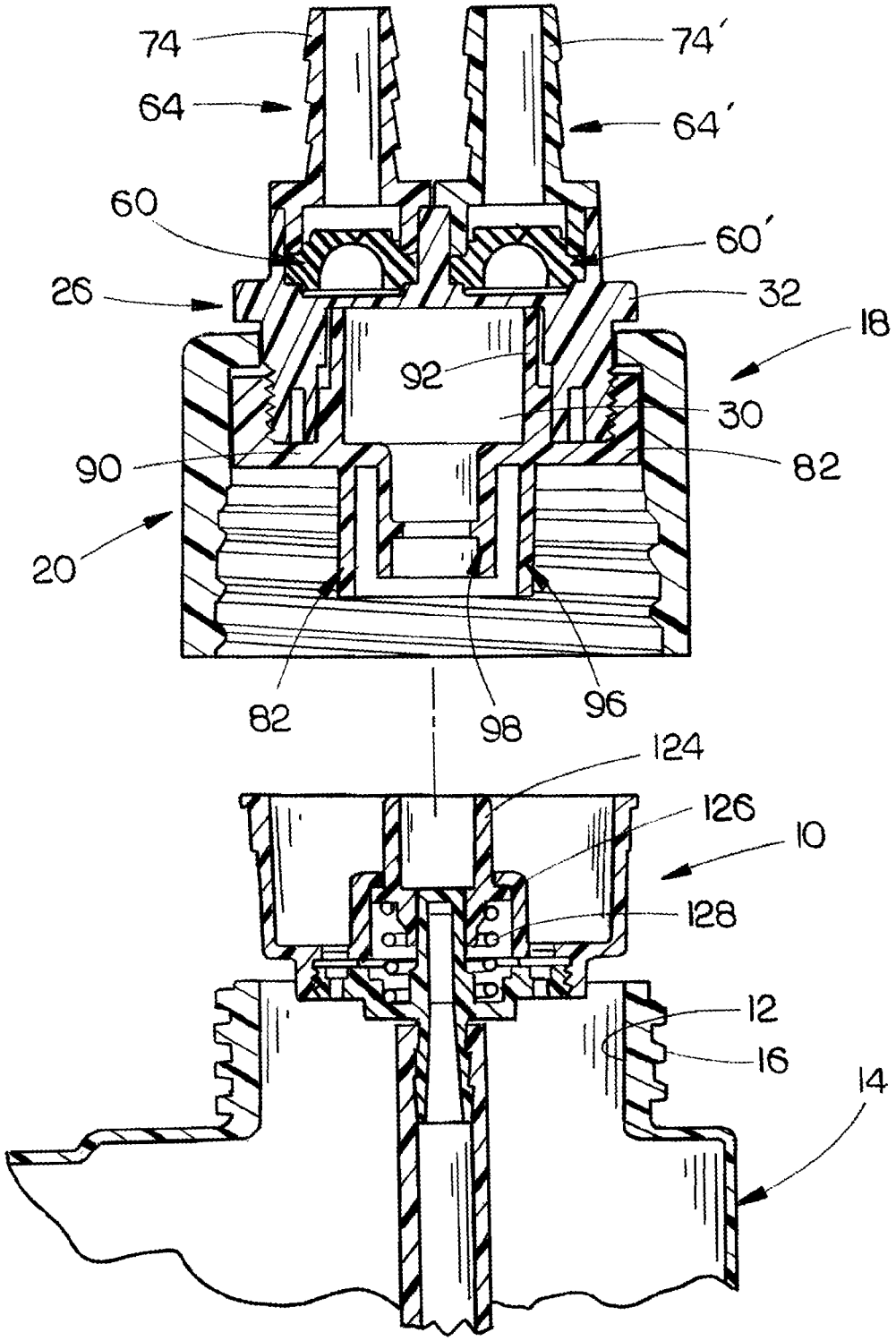
FIG. 5 is an exploded sectional view of the multi-port cap adapter of this invention and a throat plug assembly.
Figure 7:
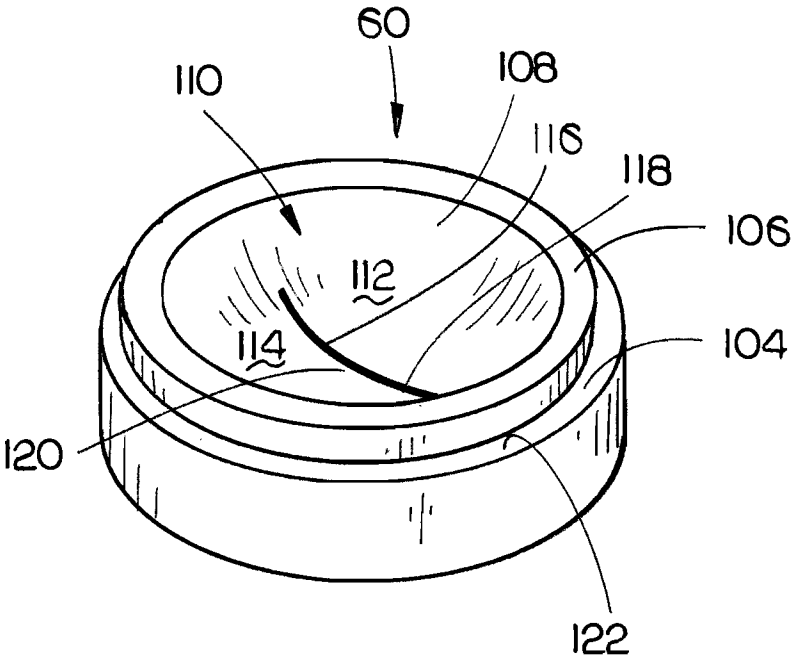
FIG. 7 is a lower perspective view of one of the low profile valves which are utilized with the multi-port cap adapter of this invention.
Figure 6:
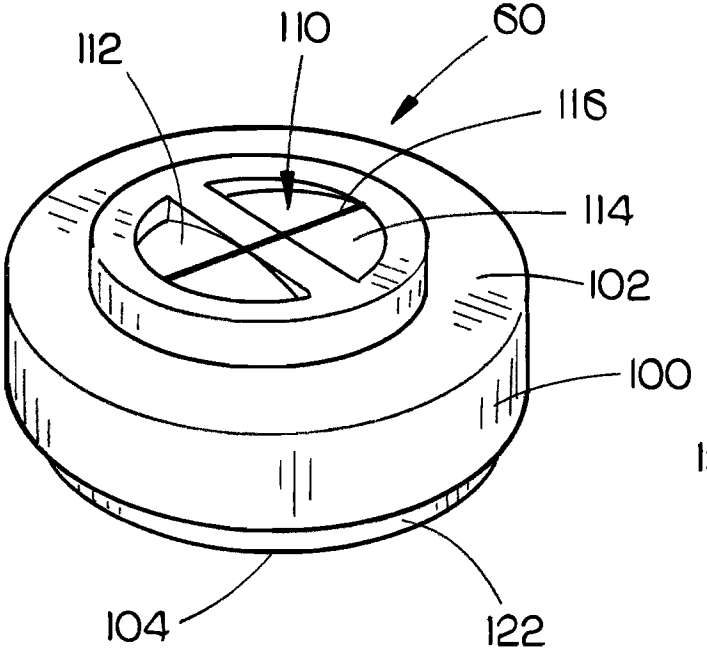
FIG. 6 is an upper perspective view of one of the low profile valves which are utilized with the multi-port cap adapter of this invention.

An exteriorly barbed hollow tube 74 extends upwardly from flange 66. Flange 66 has a hollow tubular portion 76 extending downwardly therefrom. The interiors of tube 74 and tubular portion 76 communicate with one another to permit liquid to flow therethrough. Tubular portion 76 is inserted downwardly into the upper end of bore 40 of take-off support 36, as seen in FIG. 4. Screw 78 extends downwardly through screw opening 70 in flange 66 into screw opening 46 in take-off support 36. Screw 80 extends downwardly through screw opening 72 in flange 66 into screw opening 48 in take-off support 38. Inasmuch as port 64' is identical to port 64, only port 64 will be described in detail with "'" designating duplicate structure on port 64'. Port 64' is secured to take-off support 38 in the same manner as port 64 is secured to take-off support 36 by the screws 78' and 80'.

The threaded portion 28 of upper housing 26 is inserted downwardly through the opening 22 in cap 20 until the wall 32 is resting on the upper end of the cap 20. The numeral 82 designates a lower or bottom housing which is inserted upwardly into the lower open end of cap 20. Housing 82 includes a ring-shaped body member 84 having an internally threaded portion 86 which is configured to be threadably secured to the threaded portion 28 of housing 26 to secure housings 26 and 82 together. The outer surface of body member 84 has a plurality of spaced and vertically disposed vent slots 88 formed therein. When secured together, housings 26 and 82 are selectively rotatable with respect to cap 20.

Lower housing 82 includes a horizontally disposed wall 90 which extends inwardly from the lower inner end of body member 84. A cylindrical wall member 92 extends upwardly from wall 90 outwardly of the inner end thereof and has vertically disposed notches 94 formed therein. A cylindrical tubular portion 96 extends downwardly from wall 90 and has a lower end 97. A cylindrical tubular portion 98 extends downwardly from wall 90 at the inner end and has a lower end 99. As seen, tubular portions 96 and 98 extend downwardly into the interior of cap 20 for engagement of portions of the insert 10 as will be explained in more detail hereinafter.

Valve 60, as stated, is a flexible low-profile, disc-shaped valve. Valve 60 is readily available from Vernay Laboratory of Yellow Springs, Ohio. As described in U.S. Pat. No. 5,249,598, the valve 60 of this invention is called a regulator member in the '598 Patent. Valve 60 includes an elastomeric circular body portion 100. Body portion 100 is substantially planar and defines first and second substantially planar sides 102 and 104. An inner wall portion 106 of valve 60 defines a tubular flow passageway 108 which extends through the valve 60. The tubular passageway 108 extends through a central portion of the valve 60. A dome-shaped diaphragm 110 is formed integrally with the body portion 100 and extends across the flow passageway 108 to control fluid flow in an upwardly direction through the valve 60. The diaphragm 110 includes curved or arcuate first and second surfaces 112 and 114. A normally closed slit 116 is formed in diaphragm 110 as seen in the drawings. Thus, the diaphragm 110 includes opposing lip portions 118 and 120 located on opposing sides of the slit 116, and the lip portions 118 and 120 are adapted to separate from each other to permit flow through the valve 60 in an upwardly direction. The planar side 104 of valve 60 defines a shoulder 122 which is configured to engage shoulder 42 when inserted into bore 40.

Container insert 10 will not be described in detail since insert 10 does not form a part of this invention. Insert 10 includes an upwardly extending hollow valve stem which is yieldably moved to a closed position with respect to valve body 126 by a spring 128. When cap adapter 18 is attached to the throat 12 of container 14, the lower end of tubular portion 96 engages the upper end of valve stem 124 to move the valve stem 124 downwardly in valve body 126 to permit liquid to pass upwardly through the insert 10 into the cap adapter 18.

The liquid from the container 14 is drawn upwardly into the cap retainer 18 by the associated draw-off mechanism. The vacuum pressure from the draw-off mechanism will cause valves 60 and 60' to open to permit liquid to flow upwardly therethrough. When vacuum pressure is not exerted on valves 60 and 60', the valves are closed and will prevent back flow therethrough.

The valves 60 and 60' are more dependable than the flap or umbrella valves of the '062 patent. Further, the low profile of the valves 60 and 60' enables the multi-port cap adapter of the invention to have a height less than the structure of the '062 patent. Further, the valves 60 and 60' are less prone to have material crystallizing thereon.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination:

a liquid container having upper and lower ends;

said container having an outlet opening formed in its upper end;

a cylindrical cap having a top wall with an internally threaded side wall extending downwardly therefrom;

said top wall of said cap having a circular opening formed therein;

said cap being configured to be secured to said container at said outlet opening;

a multi-port cap adapter mounted on said cap;

said cap adapter including top and bottom housings having upper and lower ends;

said top housing including a cylindrical body member having an upper end, a lower end, an inner surface and an outer surface;

said lower end of said body member of said top housing having external threads formed therein;

said body member of said top housing having a central fluid passageway extending therethrough;

said body member of said top housing having a diameter which is less than the diameter of said circular opening in said top wall of said cap;

said top housing including a horizontally disposed support wall, having upper and lower ends, at said upper end of said body member of said top housing;

said support wall having a diameter which is greater than the diameter of said circular opening in said top wall of said cap;

said lower end of said support wall positioned on said top wall of said cap with said body member of said top housing extending downwardly through said circular opening in said top wall of said cap;

said support wall having spaced-apart first and second fluid openings formed therein which communicate with said central fluid passageway in said body member of said top housing;

a first take-off support, having an upper end and a lower end, which is integrally formed with said support wall and which extends upwardly therefrom;

said first take-off support having a cylindrical first bore, having upper and lower ends, which extends downwardly thereinto;

a first support bar extending across said lower end of said first bore of said first take-off support;

said lower end of said first bore being in fluid communication with said first fluid opening in said support wall;

a flexible, low profile first valve positioned in first bore of said first take-off support;

said first valve comprising:

(a) an elastomeric circular body portion having a substantially planar upper side and a substantially planar lower side;

(b) a first ring-shaped wall portion extending downwardly from said lower side of said body portion;

(c) said first ring-shaped wall portion having a diameter which is less than the diameter of said body portion to create a first shoulder portion on said lower side of said body portion;

(d) said body portion having a tubular flow passageway, having upper and lower ends, formed therein which extends upwardly through said body portion;

(e) a dome-shaped diaphragm formed integrally with said body portion which extends across said upper end of said tubular flow passageway;

(f) said diaphragm including arcuate first and second upper surfaces having a normally closed slit formed in said diaphragm between said first and second upper surfaces;

(g) said slit configured to permit flow upwardly through said body portion;

(h) a second ring-shaped wall member extending upwardly from said upper side of said body portion;

(i) said second ring-shaped wall member having a diameter which is less than the diameter of said body portion to create a second shoulder portion on said upper side of said body portion;

said lower end of said first bore of said first take-off support having an inwardly protruding shoulder formed therein;

a horizontally disposed support bar positioned in said lower end of said first bore of said first take-off support which extends thereacross;

said first shoulder of said body portion of said first valve positioned on said inwardly protruding shoulder of said first bore of said first take-off support;

said lower side of said body portion of said first valve positioned on said support bar in said lower end of said first bore of said first take-off support;

a second take-off support, having an upper end and a lower end, which is integrally formed with said support wall and which extends upwardly therefrom;

said second take-off support having a cylindrical first bore, having upper and lower ends, which extends downwardly thereinto;

said lower end of said first bore of said second take-off support being in fluid communication with said second fluid opening in said support wall;

a flexible low profile second valve positioned in said first bore of said second take-off support;

said second valve comprising:

(a) an elastomeric circular body portion having a substantially planar upper side and a substantially planar lower side;

(b) a first ring-shaped wall portion extending downwardly from said lower side of said body portion;

(c) said ring-shaped wall portion having a diameter which is less than the diameter of said body portion to create a first shoulder portion on said lower side of said body portion;

(d) said body portion having a tubular flow passageway, having upper and lower ends, formed therein which extends upwardly through said body portion;

(e) a dome-shaped diaphragm formed integrally with said body portion which extends across said upper end of said tubular flow passageway;

(f) said diaphragm including arcuate first and second upper surfaces having a normally closed slit formed in said diaphragm between said first and second upper surfaces;

(g) said slit configured to permit flow upwardly through said body portion;

(h) a second ring-shaped wall member extending upwardly from said upper side of said body portion;

(i) said second ring-shaped wall member having a diameter which is less than the diameter of said body portion to create a second shoulder portion on said upper side of said body portion;

said lower end of said first bore of said second take-off support having an inwardly protruding shoulder formed therein;

a horizontally disposed support bar positioned in said lower end of said first bore of said second take-off support which extends thereacross;

said first shoulder of said body portion of said first valve positioned on said inwardly protruding shoulder of said first bore of said second take-off support;

said lower side of said body portion of said second valve positioned on said support bar in said lower end of said first bore of said second take-off support;

a first fluid take-off, having upper and lower ends, selectively removably mounted on said upper end of said first take-off support;

said lower end of said first take-off engaging said second shoulder portion of said body portion of said first valve when said first fluid take-off is mounted on said upper end of said first take-off support;

said first fluid take-off having a fluid passageway extending therethrough which is in fluid communication with said first bore above said first valve in said first take-off;

a second fluid take-off, having upper and lower ends, selectively removably mounted on said upper end of said second take-off support;

said lower end of said second take-off engaging said second shoulder portion of said body portion of said second valve when said second fluid take-off is mounted on said upper end of said second take-off support;

said second fluid take-off, having a fluid passageway extending therethrough which is in fluid communication with said second bore above said second valve in said second take-off;

each of said first and second fluid take-offs configured to have a dispensing tube secured thereto which extends to a draw-off mechanism which draws fluid thereinto by suction; and said bottom housing being positioned within said cap and having a ring-shaped body portion which is threadably secured to said external threads of said body member of said top housing to secure said top housing to said cap.

* * * * *